US006945924B2

(12) United States Patent
Brizzi et al.

(10) Patent No.: US 6,945,924 B2
(45) Date of Patent: Sep. 20, 2005

(54) METHOD FOR CONVEYING FOLDED SHEET ELEMENTS

(75) Inventors: Marco Brizzi, Zola Predosa (IT); Alberto Franchini, Monteveglio (IT); Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 330 days.

(21) Appl. No.: 10/184,120

(22) Filed: Jun. 27, 2002

(65) Prior Publication Data

US 2003/0019786 A1 Jan. 30, 2003

(30) Foreign Application Priority Data

Jun. 29, 2001 (IT) ..... BO2001A0411

(51) Int. Cl.[7] ..... B31F 1/00

(52) U.S. Cl. ..... 493/418; 493/315; 493/123

(58) Field of Search ..... 493/418, 412, 493/357, 408, 315, 313, 123

(56) References Cited

U.S. PATENT DOCUMENTS

| | | | | |
|---|---|---|---|---|
| 3,107,078 A | * | 10/1963 | Schutt | 248/363 |
| 4,127,263 A | * | 11/1978 | Wenthe | 271/96 |
| 4,721,462 A | * | 1/1988 | Collins, Jr. | 432/253 |
| 4,739,910 A | * | 4/1988 | Westphal et al. | 223/37 |
| 4,842,573 A | | 6/1989 | Peter et al. | 493/412 |
| 6,022,014 A | | 2/2000 | Rathert et al. | 271/11 |
| 6,176,482 B1 | | 1/2001 | Reinhard et al. | 271/227 |

FOREIGN PATENT DOCUMENTS

| | | |
|---|---|---|
| EP | 1167254 | 1/2002 |
| GB | 2302082 | 1/1997 |
| JP | 63196450 | 8/1988 |

* cited by examiner

*Primary Examiner*—Sameh H. Tawfik
(74) *Attorney, Agent, or Firm*—Ladas & Parry LLP

(57) ABSTRACT

A method and device for conveying folded sheet elements, whereby a sheet element, folded to have at least two superimposed portions connected along a fold, is fed along a given path by a movable gripping head, which engages and retains by suction a first of the two portions of the sheet element, and simultaneously deforms the fold to retain the second portion in contact with the first as the sheet element is conveyed.

11 Claims, 1 Drawing Sheet

METHOD FOR CONVEYING FOLDED SHEET ELEMENTS

The present invention relates to a method of conveying folded sheet elements.

The present invention may be used to advantage in the tobacco industry to supply a line for packing tobacco products, in particular cigarettes, with sheet elements defined by folded coupons, to which the following description refers purely by way of example.

BACKGROUND OF THE INVENTION

On some packing lines in the tobacco industry, each packet of cigarettes produced or being produced on the line is provided with a coupon, which at times is folded to form at least two superimposed portions connected along a fold.

Single-sheet coupons, i.e. defined by a nonfolded sheet element, are normally supplied to a packing line by means of a conveying member, which retains the coupons by suction and feeds them on to the line successively.

When dealing with folded coupons, however, such a conveying method, though cheap and easy to implement, poses several drawbacks, by the conveying member only engaging one of the folded portions of the coupon by suction, while the other/s, not being position controlled in any way, are allowed to "flap" freely and detach from the portion retained by suction.

SUMMARY OF THE INVENTION

It is an object of the present invention to provide a conveying method enabling even folded sheet elements to be conveyed safety by suction.

According to the present invention, there is provided a method of conveying sheet elements folded to comprise at least two superimposed portions connected along a fold; the method comprising the steps of engaging a first of said two portions of said sheet element by means of suction conveying means; deforming said first portion and said fold to retain a second of said portions in contact with said first portion; retaining said sheet element with said first portion and said fold deformed, and with said first portion in contact with the suction conveying means; and moving said suction conveying means along a given path.

The present invention also relates to a device for conveying folded sheet elements.

According to the present invention, there is provided a device for conveying sheet elements folded to comprise at least two superimposed portions connected along a fold; the device comprising movable conveying means having a suction surface for engaging a first of the two said portions; said suction surface retaining said first portion by suction, and being designed to simultaneously deform said fold to retain a second of said portions in contact with said first portion.

BRIEF DESCRIPTION OF THE DRAWINGS

The present invention will be described with reference to the accompanying drawings, in which.

DETAILED DESCRIPTION OF THE INVENTION

Figures 1, 2:
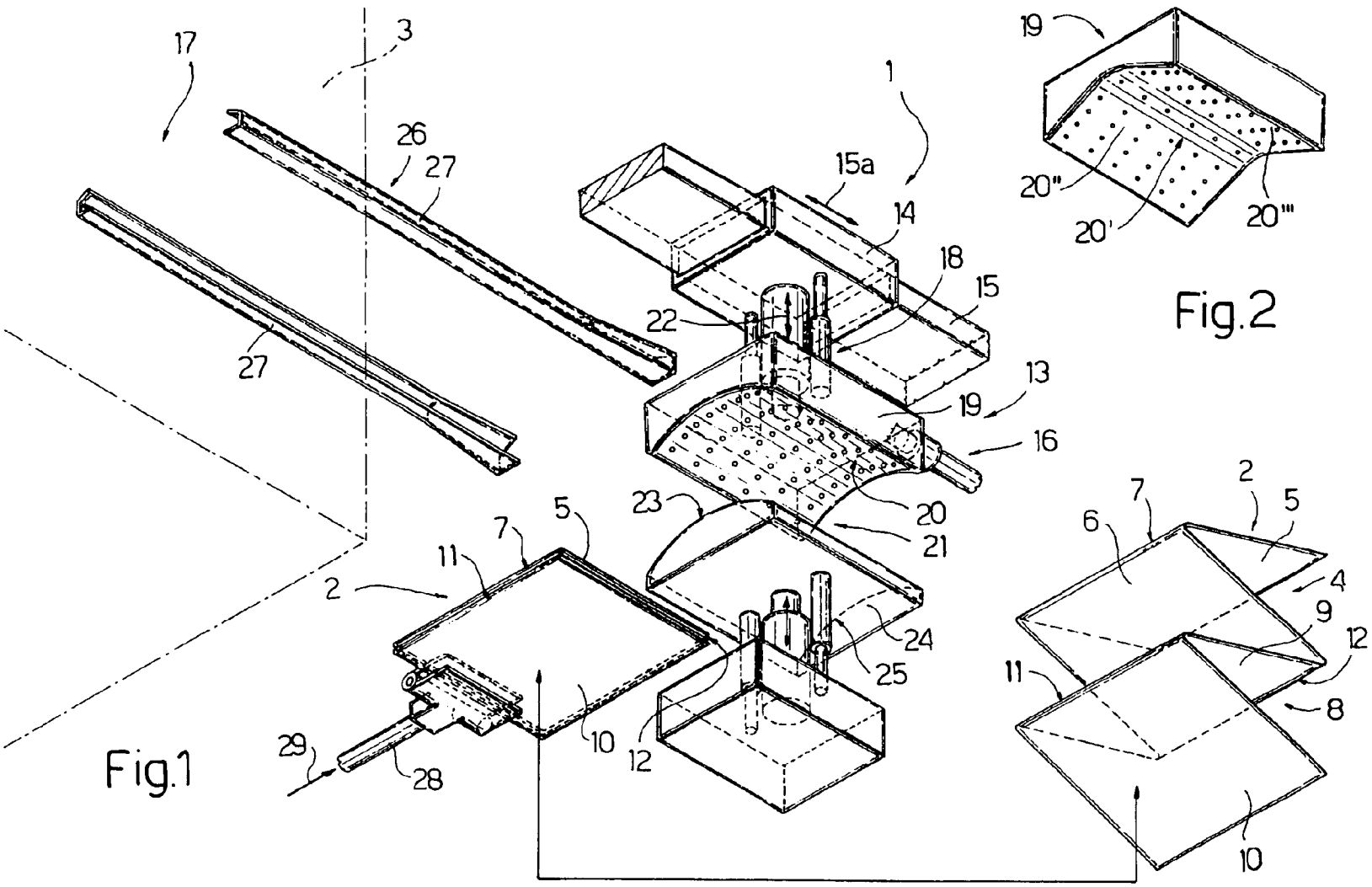
FIG. 1 shows a schematic, three-quarter underside view in perspective of a preferred non-limiting embodiment.
FIG. 2 shows a view in perspective of a second embodiment of a detail in FIG. 1.

Number 1 in FIG. 1 indicates as a whole a device for conveying and feeding a coupon 2 to a known cigarette packing line 3.

In the example shown, coupon 2 is fan-folded, and comprises a first pair 4 of superimposed portions 5 and 6 connected to each other along a fold 7; and a second pair 8 of superimposed portions 9 and 10 connected to each other along a fold 11 parallel to fold 7. Portions 6 and 9 are also connected to each other along a fold 12 parallel to and opposite folds 7 and 11.

Device 1 comprises a transfer unit 13, in turn comprising a slide 14 powered in known manner (not shown) to run back and forth, along a guide 15 and in a direction 15*a* which, in the example shown, is substantially horizontal, between a pickup station 16, to pick up a coupon 2, and a feed station 17, to feed coupon 2 to packing line 3. Transfer unit 13 also comprises a telescopic actuator 18 suspended from slide 14 and fitted on its bottom free end with a gripping head 19, which is defined at the bottom by a suction surface 20 facing a gripping position 21 of pickup station 16, and is moved by actuator 18 to and from gripping position 21 in a direction 22 which, in the example shown, is substantially vertical.

Surface 20 is a cylindrical curved surface (concave in the example shown) with generating lines parallel to direction 15*a*, and faces a cylindrical curved surface 23 (concave in the example shown), complementary to surface 20 and with generating lines parallel to direction 15*a*, of an anvil 24, which is located on the opposite side of pickup station 16 with respect to transfer unit 13, and is moved to and from gripping position 21 in direction 22 by a telescopic actuator 25 which is substantially coaxial with actuator 18 when transfer unit 13 is at pickup station 16.

In a variation not shown, anvil 24 has an actuator 25, and is fixed at gripping position 21.

Device 1 also comprises a guide 26 extending, parallel to direction 15*a*, between pickup station 16 and feed station 17, and which is coplanar with gripping position 21 and comprises two channel sections 27 positioned with their concavities facing each other, and separated by a distance substantially equal to the length of folds 7, 11 and 12.

Finally, device 1 comprises a feed device 28 for feeding coupons 2 to pickup station 16. In the example shown, device 28 is a known gripper-type feed device, which moves to and from pickup station 16 in a direction 29 perpendicular to directions 15*a* and 22, to feed each coupon 2 to gripping position 21 with folds 7, 11 and 12 extending crosswise to the generating lines of surfaces 20 and 23.

In actual use, when a coupon 2, positioned with folds 7, 11 and 12 parallel to direction 29, is fed by feed device 28 to gripping position 21, transfer unit 13 is located at pickup station 16, and gripping head 19 and anvil 24 are raised and lowered respectively with respect to gripping position 21. Gripping head 19 and anvil 24 are then moved towards each other to grip coupon 2 between surfaces 20 and 23, which, cooperating with each other, curve folds 7, 11 and 12, which are "frozen" in this curved position by activating suction through surface 20. The suction, in fact, by acting directly on at least portion 5 and fold 7 of coupon 2, itself keeps these two elements in the curved position even without anvil 24. Maintaining a curved fold 7 also keeps portion 6 and fold 12 curved, so that portions 9 and 10 and fold 11 are also maintained curved and so adhere to portions 5 and 6 even without anvil 24.

At this point, anvil 24 can be lowered and the slide moved in direction 15*a* to feed coupon 2 along guide 26 to feed station 17. In the course of this movement, any lateral portions of coupon 2 projecting crosswise to direction 15*a* from gripping head 19 engage the inside of respective sections 27, which may even be dispensed with and serve solely to prevent coupons 2 from dropping in the event suction is cut off, and possibly also to center coupons 2 with respect to gripping head 19.

As will be clear from the foregoing description, to engage a folded sheet element by suction along at least one fold and convey the sheet element, without flapping, along a given path, the fold must be maintained curved as the element is conveyed. And when dealing with multiple parallel folds, as in the example shown, all the folds must obviously be maintained curved as the element is conveyed.

Though, in the example shown, surface 20 is concave and surface 23 convex, the same result would obviously be achieved even with a convex surface 20 and a concave surface 23. Surface 20 may also have any shaped curve, or even be undulated.

In the FIG. 2 example, surface 20 of gripping head 19, when sectioned crosswise to direction 15*a*, is substantially V-shaped and defined by two flat portions 20" and 20"' connected by a rib 20'.

As will be clear from the foregoing description, once folds 7, 11 and 12 are all curved by the opposite pressures exerted by gripping head 19 and anvil 24, the suction through surface 20, by acting directly on portion 5 and fold 7, is sufficient to keep all folds 7, 11 and 12 curved, so that portions 5, 6, 9 and 10 all adhere to one another and to surface 20. When dealing with a coupon only comprising portions 5 and 6 and fold 7, however, gripping head 19 is obviously perfectly capable of curving portion 5 and fold 7, and therefore also portion 6, by suction alone. Consequently, to convey by suction a sheet element simply folded into two along one fold, anvil 24 may be dispensed with or replaced, if necessary, by a straightforward fixed flat supporting plate defining gripping position 21.

The same also applies when conveying by suction a sheet element folded into four along two parallel, superimposed first folds and a further intermediate fold crosswise to the other two. In which case, the intermediate fold need simply be curved directly by suction, so that all the portions of the sheet element adhere to the portion of the sheet element contacting gripping head 19 and subjected to suction.

To convey a sheet element folded along three or more folds forming an angle, surfaces 20 and 23 must be complementary and have, as opposed to a single curve as in the example shown, a double curve so as to curve all the folds in the sheet element to be conveyed.

What is claimed is:

1. A method of conveying sheet elements (2) folded to comprise at least two superimposed portions (5, 6, 9, 10) connected along a number of folds (7, 11, 12); the method comprising the steps of engaging the sheet element (2) by means of suction conveying means (19);

moving the suction conveying means (19) along a given path for feeding the sheet elements (2) along the given path;

initially bringing the sheet element (2) in contact with a curved suction surface (20) of the suction conveying means (19) for deforming the sheet element (2) so as to arrange the sheet element (2) in a curved configuration in which all the folds (7, 11, 12) of the sheet element (2) have substantially the same curvature;

maintaining the sheet element (2) in the curved configuration by maintaining a first upper portion (5) of the sheet element (2) contacting the curved suction surface (20) of the suction conveying means (19); and feeding the sheet element (2) in the curved configuration along the given path when the sheet element (2) is supported only by the curved suction surface (20) of the suction conveying means (19).

2. A method as claimed in claim 1, wherein said curved suction surface (20) has a circular curved section when sectioned in a plane parallel to said folds (7) and crosswise to the folded sheet element (2).

3. A method as claimed in claim 2, wherein said curved suction surface (20) has a substantially V-shaped curved section when sectioned in a plane parallel to said folds (7) and crosswise to the folded sheet element (2).

4. A method as claimed in claim 1, wherein said curved suction surface (20) cooperates, with the interposition of the folded sheet element (2), with a complementary surface (23) carried by opposing means (24).

5. A method as claimed in claim 4, wherein said opposing surface (23) and said curved suction surface (20) are movable with respect to each other to grip a said sheet element (2) and deform said portions (5, 6,9, 10) and said folds (7, 11, 12).

6. A method as claimed in claim 4 comprising forming said curved suction surface as a continuous curved surface on which the sheet element is maintained by suction and moved by moving said curved suction surface along said given path while a lower portion of said sheet element moves freely therewith.

7. A method as claimed in claim 1 comprising keeping a second lower portion of the sheet element (2) free to enable the sheet element (2) to be transported only by the curved suction surface (20) of the suction conveying means (19).

8. A method as claimed in claim 7 comprising moving the curved suction surface of the suction conveying means to feed the sheet element in its curved configuration along the given path while the second portion of the sheet element follows the movement of the first portion.

9. A method as claimed in claim 1, wherein a second lower portion of the sheet element is free and unrestrained when the sheet material is moved by the suction conveying means along said given path.

10. A method as claimed in claim 1, wherein the sheet element is fed along its given path by moving the suction conveying means to transport the sheet material therewith.

11. A method as claimed in claim 10 comprising engaging a second lower surface of the sheet material by an anvil and moving said anvil in correspondence with said suction conveying means so that said lower surface moves in correspondence with the moving of the upper surface.

* * * * *

UNITED STATES PATENT AND TRADEMARK OFFICE

CERTIFICATE OF CORRECTION

PATENT NO. : 6,945,924 B2
DATED : September 20, 2005
INVENTOR(S) : Marco Brizzi et al.

It is certified that error appears in the above-identified patent and that said Letters Patent is hereby corrected as shown below:

Title page,
Item [*] Notice, “330” should read -- 333 --.

Signed and Sealed this

Fourteenth Day of March, 2006

JON W. DUDAS
*Director of the United States Patent and Trademark Office*